US006071081A

United States Patent [19]

Shiraishi

[11] Patent Number: 6,071,081

[45] Date of Patent: Jun. 6, 2000

[54] HEAT-POWERED LIQUID PUMP

[75] Inventor: Sadasumi Shiraishi, Tokyo, Japan

[73] Assignee: Seiko Instruments Inc., Japan

[21] Appl. No.: 08/016,712

[22] Filed: Feb. 11, 1993

[30] Foreign Application Priority Data

Feb. 28, 1992 [JP] Japan ..... 4-43978

[51] Int. Cl.[7] ..... F04B 19/24

[52] U.S. Cl. ..... 417/52; 417/207; 417/209

[58] Field of Search ..... 417/52, 207, 208, 417/209

[56] References Cited

U.S. PATENT DOCUMENTS

| | | | |
|---|---|---|---|
| 3,065,712 | 11/1962 | Buchanan et al. | 417/209 |
| 3,087,438 | 4/1963 | Chiesielski | 417/207 |
| 3,648,018 | 3/1972 | Cheng et al. | 417/52 |
| 4,470,759 | 9/1984 | Kosson | 417/208 |
| 4,723,129 | 2/1988 | Endo et al. | 417/207 |
| 4,792,283 | 12/1988 | Okayasu | 417/52 |
| 4,805,804 | 2/1989 | Raczkowski | 417/207 |
| 5,053,787 | 10/1991 | Terasawa et al. | 364/1.1 |
| 5,129,788 | 7/1992 | Okayasu | 417/52 |

FOREIGN PATENT DOCUMENTS

| | | | |
|---|---|---|---|
| 859743 | 12/1952 | Germany | 417/52 |
| 20407 | 2/1977 | Japan | 417/52 |
| 1488546 | 6/1989 | U.S.S.R. | 417/52 |
| 1300401 | 12/1972 | United Kingdom | 417/207 |

*Primary Examiner*—Charles G. Freay
*Attorney, Agent, or Firm*—Adams & Wilks

[57] ABSTRACT

A liquid transport device has a chamber, an inlet and an outlet for supplying liquid to and from the chamber through one-way valves, and a bubble forming system for film boiling the liquid to form a precisely controlled film bubble which expands and contracts within the liquid. The expansion and contraction motion of the bubble acts as a pressure source for expelling liquid from the chamber during bubble expansion and withdrawing liquid into the chamber during bubble contraction. Pulses of heat energy are applied to the liquid to form the film bubbles, either by pulse driving an electric heating element with power pulses or by irradiating the liquid with laser beam pulses.

26 Claims, 2 Drawing Sheets

HEAT-POWERED LIQUID PUMP

FIELD OF THE INVENTION

The present invention relates to a transport mechanism founded on a new theory in a fluid transport device such as a pump. The present invention more specifically relates to a micropump for transporting a trace of fluid and which is small-sized and lightweight, has high-speed response characteristics and can be precisely controlled.

BACKGROUND OF THE INVENTION

There are conventional methods of generating pressure for fluid transportation in a micropump mechanism. For example, as shown in Japanese Laid-Opened Utilities Nos. 61180/1991 and 137582/1990, and Japanese Laid-Opened Patent No. 242266/1988, one of the methods is such that a vibrator is provided in a cavity, and the vibration of the vibrator is caused by means of the elasticity of a piezoelectric element or revolution control of a motor to generate pressure for transporting fluid. Japanese Laid-Opened Patent No. 126387/1986 and Japanese Patent No. 32231/1982 disclose another method for generating pressure by changing the volume of the cavity itself using the elasticity of the piezoelectric element.

The above conventional methods have large restrictions in order to miniaturize, lighten and reduce electric power of the pump mechanism because mechanical motion by the mechanism elements is the pressure source in the above conventional methods. More specifically, the displacement of the vibrator to an extent larger than a certain quantity is required to transport a desired quantity of fluid. Therefore the vibrator has to be large in order to obtain such a large displacement, and a good deal of energy is needed to effect displacement of the vibrator. Further, the pump mechanism itself is complicated because it includes a moving portion. As stated above, the conventional methods have trouble in miniaturizing, lightening and controlling precisely and in saving electricity of the pump mechanism.

SUMMARY OF THE INVENTION

The object of the present invention is to provide a simplified pump mechanism which overcomes the above-described drawbacks.

The present invention applies a film boiling phenomenon which occurs when fluid to be transported is heated to high temperature instantly, and uses the motion of the film bubble caused by the film boiling to transport the fluid.

Liquid heated in a cavity creates a film bubble. If the film bubble undergoes repeated expansion and shrinkage, the liquid can be transported in the cavity by the change in volume of the cavity caused by the expanding and shrinking film bubble. In this manner, discrete volumetric quantities of liquid, corresponding to the volume of the film bubbles, can be transported.

The above structure enables the present invention to provide a simplified pump mechanism.

DETAILED DESCRIPTION OF THE INVENTION

Referring to FIG. 3, the film boiling phenomenon, which is a principle of the present invention, and the behavior of a bubble caused by the film boiling phenomenon will be explained below.

Figure 1:
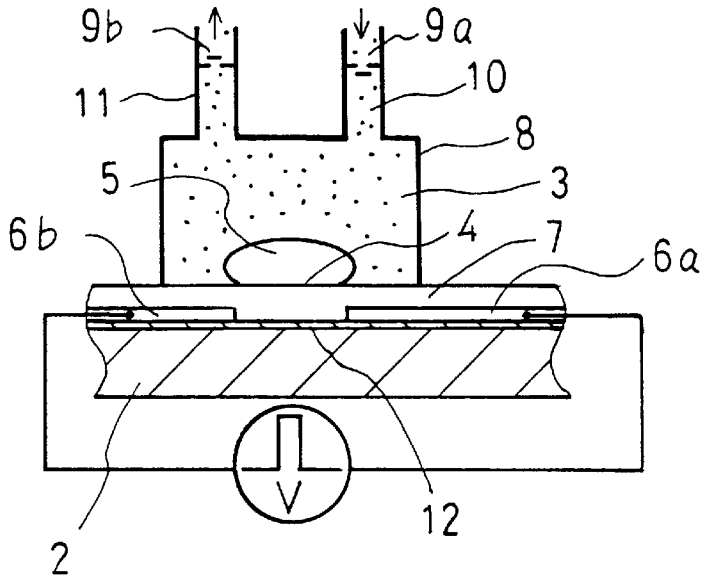
FIG. 1 is a cross section showing a first embodiment of the present invention.
Figures 3A, 3B, 3C:
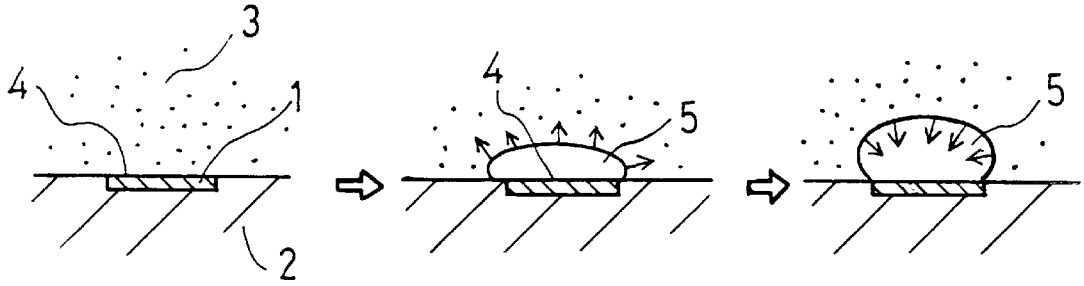
FIGS. 3*a*–3*c* are explanatory diagrams showing a principle of the present invention.

In FIG. 3*a*, 1 is a heater formed on a heater board 2 and 3 is a liquid. An electric heat pulse is applied to the heater 1 to generate a sufficient quantity of heat for the liquid 3 to reach an overheated or superheated state in a short time $T_0$. When such a high heat flux flows from a heat transfer surface 4 to the liquid 3, the portion of the liquid 3 which touches the heat transfer surface 4 causes a film boiling phenomenon and a film bubble 5 in a film state is formed on the heat transfer surface 4 as shown in FIG. 3*b*. Internal pressure at the early stage of the film bubble 5 is so high that the film bubble 5 expands quickly to a certain volume. Since the film bubble 5 is cooled by the liquid 3 which surrounds the film bubble 5 and loses its internal pressure quickly while growing, the film bubble 5 starts to shrink quickly as soon as it grows to a certain volume as shown in FIG. 3*c*. At that stage, the heat pulse supplied to the heater 1 has already finished. Therefore the film bubble 5 does not expand again but contracts and disappears.

As stated above, the film bubble 5 repeats a cycle of creation, expansion, shrinkage and disappearance in sequence, at the same spot on the heat transfer surface, for every application of a pulse of heat energy (referred to hereafter as heat pulse). In this one cycle, when the film bubble 5 expands, a pressure radially occurs from the heat transfer surface 4 to the liquid 3 in a diffusion direction. On the other hand, when the film bubble film 5 shrinks or contracts, a shrink pressure occurs toward the heat transfer surface 4.

Therefore it can be possible to transport the liquid 3 in discrete volumetric quantities in one direction by equipping both a nozzle which has an outlet valve for liquid and a nozzle which has an inlet valve for liquid in a cavity or chamber where the heater 1 of the heater board 2 is formed on one of the walls.

(Embodiment 1)

FIG. 1 shows an embodiment in which a heat resistor 12 is employed as a heater and joule heat caused by pulse supply to the heat resistor 12 is used as a heat source of boiling. The heat resistor 12, electrodes 6*a* and 6*b* for energizing the heat resistor 12, and a protective layer 7 are formed on a heater board 2. Film forming techniques such as sputtering and photolithography are applied to form these elements as a laminated film. A cavity or chamber 8 is provided such that the heat resistor 12 is formed on one of the inside walls which define the cavity 8. Further, both an inlet nozzle 10 equipped with a one-way inlet valve 9*a* and an outlet nozzle 11 equipped with a one-way outlet valve 9*b* are provided for controlling the flow of liquid through the cavity 8.

Joule heat is generated by the heat resistor 12 by supplying a pulsed voltage between the electrodes 6*a* and 6*b*. This joule heat quickly heats the liquid 3 which touches a heat transfer surface 4 through the protective layer 7. When a film bubble 5 appears on the heat transfer surface 4 and grows, expansion pressure occurs. The outlet valve 9*b* opens by the expansion pressure while the inlet valve 9*a* is left closed. Thus, the liquid 3 is pushed out of the cavity 8 by the expanding film bubble 5. On the other hand, when the film bubble 5 shrinks, shrinkage pressure occurs toward the heat transfer surface 4. The inlet valve 9*a* opens by the shrinkage pressure while the outlet valve 9*b* closes by such pressure. Thus, the cavity 8 is filled up again with the liquid 3. In this way, a discrete volumetric quantity of the liquid 3 is transported in a uniform direction.

Calorific power and heating rate that are more than a certain value are required to cause a film boiling phenomenon steadily. Testing by the present inventor was carried out using pure water as the liquid, the heat resistor 12 of 150×50 $\mu m^2$, a heating rate of $7\times10^9$ watt/$m^2$, and a supplied pulse width of 10 $\mu$sec. As a result, a film bubble having a volume of 150×50×50 $\mu m^3$ appeared at the maximum growth. It took about 15 $\mu$sec from the beginning of the pulsed voltage supply to extinction of the bubble film. Furthermore, the following were observed. A maximum volume of a bubble changes by a heating rate, namely, a voltage at a heating rate over a certain rate. The higher the heating rate is, the larger the volume of the film bubble becomes.

In the conventional method which employes a vibrator, such as diaphragm, for a pressure source, in order to obtain almost the same displacement volume as the above bubble volume, a huge amount of energy is required. Moreover, considering the strength of the vibrator, it is actually impossible to displace 50 $\mu$m with the above size. Thus, the size of the vibrator has to be extrememly expanded so as to displace greatly.

As stated above, the following excellent performance which is necessary for a fluidic device is obtained according to the present invention which applies film boiling. Its pump mechanism is miniaturized and lightened while obtaining a large transportation quantity with low energy consumption. Further, the transportation quantity can be precisely controlled by controlling the area of the heater, the heating rate, pulse width, and pulse frequency.

(Embodiment 2)

Figure 2:
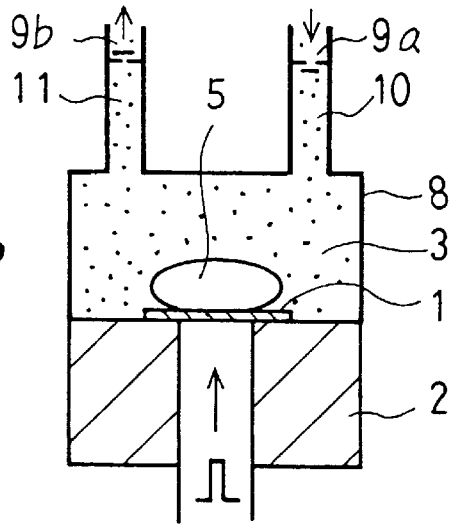
FIG. 2 is a cross section showing a second embodiment of the present invention.

FIG. 2 shows another embodiment wherein a laser beam is used for a heat source for generating the pulses of heat energy. In the embodiment 2, a heater 1 is repeatedly heated in pulses by a pulse laser beam which is guided from the back of a heater board 2. The operation hereafter is the same as the embodiment 1.

The heater 1 is made out of an aluminum nitride thin film which has high heat durability and high thermal conductivity, and so on.

The embodiment 2 has the advantage of having extremely high pulse control due to using a laser beam, of eliminating influence of deterioration of a heater which is caused by electro-chemical mutual action between the liquid and the heater, and of improving durability of the device to a large extent.

As stated above, the present invention utilizes the behavior of the film bubble, namely, expansion and shrinkage, as a pressure source of a fluid transporting mechanism, which is caused by film boiling phenomenon of the liquid under a pulse heating condition of the heater. Therefore the fluidic device can be miniaturized and lightened while obtaining a large transportation quantity with low energy consumption. Furthermore it is possible to control the transportation quantity precisely.

What is claimed is:

1. A fluid device comprising: a heater board having a pulse-driven heater on a surface portion thereof, means defining a cavity defined in part by said surface portion of said heater board, a one-way inlet valve for admitting liquid into said cavity, and a one-way outlet valve for discharging liquid from said cavity, wherein the liquid is instantaneously heated to a superheated state and film boiled to form a bubble by pulse driving said heater, said liquid is pushed from said cavity while the film bubble expands, said cavity is filled with said liquid while said film bubble shrinks, and said liquid is transported in a certain direction.

2. A fluid device as claimed in claim 1, wherein said heater comprises a heat resistor, and further including means for supplying power in pulses to said heat resistor to cause the same to generate heat.

3. A fluid device as claimed in claim 1, including means for pulse irradiating said heater with a laser beam to heat said heater.

4. A liquid transport device comprising: means defining a chamber; an inlet having a one-way valve for admitting liquid into the chamber; an outlet having a one-way valve for discharging liquid from the chamber; and bubble forming means for film boiling the liquid by rapidly heating the liquid to its superheated state to form therein a film bubble which expands and contracts at the same spot in the chamber such that the expansion and contraction motion of the film bubble acts as a pressure source to force liquid from the chamber through the outlet during expansion of the film bubble and to draw liquid through the inlet into the chamber during contraction of the film bubble.

5. (Twice Amended) A liquid transport device according to claim 4; wherein the bubble forming means comprises means for repeatedly forming a film bubble at the same spot in the chamber by film boiling the liquid.

6. A liquid transport device according to claim 4; wherein the bubble forming means comprises means for applying a pulse of heat energy to the liquid in the chamber effective to form a film bubble by film boiling the liquid.

7. A liquid transport device according to claim 6; wherein the means for applying a pulse of heat energy comprises a heating resistor, and means for applying an electric power pulse to the heating resistor to cause the heating resistor to generate a pulse of heat energy.

8. A liquid transport device according to claim 7; wherein the means for applying an electric power pulse includes means for applying an electric power pulse having a preselected pulse width preselected to control the size of the film bubble.

9. A liquid transport device according to claim 7; wherein the means for applying an electric power pulse includes means for applying a succession of electric power pulses at a preselected frequency preselected to control the flow rate of liquid through the chamber.

10. A liquid transport device according to claim 7; including a protective layer interposed between the heating resistor and the interior of the chamber.

11. A liquid transport device according to claim 7; wherein the means defining the chamber includes a heater board, the heating resistor being disposed on the heating board facing the chamber.

12. A liquid transport device according to claim 11; including a protective layer formed over the heating resistor to prevent direct contact between the heating resistor and the liquid in the chamber.

13. A liquid transport device according to claim 6; wherein the means for applying a pulse of heat energy comprises means for irradiating the chamber with a laser beam pulse to generate a pulse of heat energy.

14. A liquid transport device according to claim 6; wherein the means for applying a pulse of heat energy comprises a heater, and means for irradiating the heater with a laser beam pulse to cause the heater to generate a pulse of heat energy.

15. A liquid transport device according to claim 14; wherein the heater is composed of a material having high thermal conductivity.

16. A liquid transport device according to claim 14; wherein the means for irradiating comprises means for irradiating the heater with a succession of laser beam pulses to generate a succession of heat energy pulses.

17. A liquid transport device for transporting liquid in discrete volumetric quantities, comprising: means defining a chamber having an inlet through which liquid is drawn into the chamber and an outlet through which liquid is discharged from the chamber; a one-way valve disposed in the inlet for admitting liquid into the chamber; a one-way valve disposed in the outlet for discharging liquid from the chamber; and means including a heat transfer surface for applying pulses of heat energy to liquid within the chamber to film boil the liquid, each pulse being effective to rapidly heat the liquid to its superheated state to film boil the liquid and create a film bubble which forms and expands on the heat transfer surface during application of the heat energy pulse to thereby discharge a discrete volumetric quantity of liquid through the chamber outlet due to expansion of the film bubble and which thereafter contracts on the heat transfer surface to thereby draw liquid through the chamber inlet due to contraction of the film bubble.

18. A liquid transport device according to claim 17; wherein the means for applying pulses of heat energy comprises a heating resistor, and means for applying electric power pulses to the heating resistor to cause the heating resistor to generate pulses of heat energy.

19. A liquid transport device according to claim 18; wherein the means for applying electric power pulses includes means for applying electric power pulses having a preselected pulse width preselected to control the size of the film bubbles and thus the volumetric quantity of liquid being transported through the chamber.

20. A liquid transport device according to claim 18; wherein the means for applying electric power pulses includes means for applying a succession of electric power pulses at a preselected frequency preselected to control the flow rate of liquid transport through the chamber.

21. A liquid transport device according to claim 18; including a protective layer interposed between the heating resistor and the interior of the chamber.

22. A liquid transport device according to claim 18; wherein the means defining the chamber includes a heater board, the heating resistor being disposed on the heating board facing the chamber.

23. A liquid transport device according to claim 22; including a protective layer formed over the heating resistor to prevent direct contact between the heating resistor and the liquid in the chamber, the protective layer having a surface which is exposed to the interior of the chamber and which comprises the heat transfer surface.

24. A liquid transport device according to claim 17; wherein the means for applying pulses of heat energy comprises a heater which has a portion comprising the heat transfer surface, and means for irradiating the heater with laser beam pulses to cause the heater to generate pulses of heat energy for heating the heat transfer surface.

25. A liquid transport device according to claim 24; wherein the heater is composed of a material having high thermal conductivity.

26. A liquid transport device according to claim 24; wherein the means for irradiating comprises means for irradiating the heater with a succession of laser beam pulses to generate a succession of heat energy pulses.

* * * * *